US007589459B2

(12) United States Patent
Hamid et al.

(10) Patent No.: US 7,589,459 B2
(45) Date of Patent: Sep. 15, 2009

(54) INFRARED RADIATION AUTOMOTIVE LAMP FILTER

(75) Inventors: Muhammed Aqil Hamid, Canton, MI (US); Charles Frederick Schweitzer, Livonia, MI (US); Nasir Mahmood, Canton, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 0 days.

(21) Appl. No.: 11/635,167

(22) Filed: Dec. 7, 2006

(65) Prior Publication Data

US 2008/0136303 A1 Jun. 12, 2008

(51) Int. Cl.
*H01J 7/24* (2006.01)

(52) U.S. Cl. ..... 313/33; 313/112

(58) Field of Classification Search ..... 313/33, 313/627–643, 567, 111–117, 17–28, 318.01–318.09; 439/615, 739; 445/24, 26, 29, 22
See application file for complete search history.

(56) References Cited

U.S. PATENT DOCUMENTS

| | | | | |
|---|---|---|---|---|
| 2,596,469 | A * | 5/1952 | Cooper, Jr. | 313/578 |
| 3,936,686 | A | 2/1976 | Moore | |
| 4,017,758 | A | 4/1977 | Almer et al. | |
| 4,338,540 | A * | 7/1982 | Sovilla | 313/579 |
| 4,517,491 | A | 5/1985 | Otto et al. | |
| 5,719,468 | A * | 2/1998 | Takanishi et al. | 313/578 |
| 5,844,364 | A | 12/1998 | Beardmore | |
| 7,204,611 | B2 * | 4/2007 | Kupper | 362/255 |
| 7,331,690 | B2 * | 2/2008 | Schmidt | 362/293 |
| 2004/0021420 | A1 * | 2/2004 | Tsuda et al. | 313/638 |
| 2007/0057610 | A1 * | 3/2007 | Allen et al. | 313/17 |

* cited by examiner

*Primary Examiner*—Peter J Macchiarolo
*Assistant Examiner*—Donald L Raleigh
(74) *Attorney, Agent, or Firm*—MacMillan, Sobanski & Todd, LLC

(57) ABSTRACT

A thermal filter is provided within a vehicle lamp assembly for reducing thermal radiation from reaching selected portions of the lamp assembly from an illumination light source disposed within the vehicle lamp. The thermal filter includes an inner envelope and an outer envelope in spaced relation to the inner envelope. The inner envelope and the outer envelope define a closed chamber therebetween. The closed chamber being disposed between the illumination light source and the selected portions of the lamp assembly. The inner envelope includes an interior portion. A thermal radiation absorbing agent disposed within the closed chamber. The thermal radiation absorbing agent receives radiation emitted from the illumination source. The thermal radiation absorbing agent is transparent to short wave visible radiation and is substantially opaque to long wave infrared radiation. A substantial portion of the long wave infrared radiation absorbed by the absorbing agent is retained within the closed chamber.

20 Claims, 1 Drawing Sheet

INFRARED RADIATION AUTOMOTIVE LAMP FILTER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates in general to incandescent vehicle lamps, and more specifically, to an efficient infrared radiation absorbing filter for an automotive lamp.

2. Background of Related Art

A lamp assembly for a vehicle typically includes a reflective housing enclosed by a transparent lens. A replaceable incandescent light source is coupled to a removable socket adjacent a rear reflective surface within the reflective housing. The illumination source extends into an interior space through an aperture formed in the rear of the reflective housing. The removable socket couples to the rear of the reflective housing for securing the removable socket and illumination light source to the lamp assembly.

The illumination light source emits radiation of all wavelengths. Short wave infrared radiation is the desirable radiation since short waves infrared radiation is within the visible range of light spectrum. Long wave infrared radiation is undesirable radiation since long wave infrared radiation is in the non-visible range of the light spectrum. For an illumination source such as a light bulb, only 5% to 10% of the total emitted radiation is visible light (i.e., short wave) and 90% to 95% is parasitic radiation (i.e., long wave) which only contributes to thermal heat and not light.

The heat generated by the long wave infrared radiation causes thermal management issues within the vehicle lamp assembly. Due to the heat generated by the long wave infrared radiation, lamp assemblies must be designed to thermally manage the heat. This typically includes added cost to the components of the lamp assembly for providing material that can withstand and manage the heat generated by the long wave radiation. Other issues involve design constraints which are the result of the heat generated. Heat reducing devices such as ventilators may be added to the lamp assembly but such devices require added cost. In addition, as the lamp cools and contracts, atmospheric air is drawn into the interior of lamp assembly as a vacuum thereby creating a passage for moisture and dust into the lamp assembly. Lamp assemblies are typically sealed components specifically to prevent any moisture or contaminants from entering the interior of the lamp assembly. Therefore, there is a need to reduce the heat generated by the illumination light fixture from reaching interior components within the lamp assembly without utilizing vents and the like.

BRIEF SUMMARY OF THE INVENTION

The present invention includes at least one advantage of reducing a substantial portion of the long wave infrared radiation from reaching a substantial portion of the internal components of a lamp assembly which reduces the heat acting on these components. By reducing the heat exposure to the components of the lamp assembly, material cost may be reduced for those components not exposed to the heat. In addition, complex designs required to avoid extreme heat exposure to internal components may be since such components are not subjected to the extreme heat.

In one aspect of the present invention, a thermal filter is provided within a vehicle lamp assembly for reducing thermal radiation from reaching selected portions of the lamp assembly from an illumination light source disposed within the vehicle lamp. The thermal filter includes an inner envelope and an outer envelope in spaced relation to the inner envelope. The inner envelope and the outer envelope define a closed chamber therebetween. The closed chamber being disposed between the illumination light source and the selected portions of the lamp assembly. The inner envelope includes an interior portion. A thermal radiation absorbing agent disposed within the closed chamber. The thermal radiation absorbing agent receives radiation emitted from the illumination source. The thermal radiation absorbing agent is transparent to short wave visible radiation and is substantially opaque to long wave infrared radiation. A substantial portion of the long wave infrared radiation is absorbed by the absorbing agent is retained within the closed chamber.

In yet another aspect of the present invention, a lamp assembly is provided for a vehicle lamp. An illumination light source radiates short wave radiation and long wave infrared radiation. A lamp housing includes a reflective surface on an interior surface of the lamp housing. A socket retains an illumination light source at a predetermined position for illuminating the reflective surface. A thermal filter is disposed between the reflective surface and the illumination light source. The thermal filter comprises a glass chamber containing a thermal radiation absorbing agent disposed within the glass chamber.

In yet another aspect of the present invention, a lamp assembly is provided for a vehicle that includes a lamp housing with a transparent lens affixed to the housing. An illumination light source radiates infrared radiation. A socket provides an electrical connection to the illumination light source. A thermal filter assembly is disposed within the lamp housing enclosing the illumination light source. The filter assembly includes an open end coupled to the socket. The filter assembly includes an inner envelope having an interior portion. The interior portion substantially encloses the illumination light source. An outer envelope is positioned proximal to the inner envelope within the lamp housing. The outer envelope and the inner envelope form a closed chamber therebetween. A thermal radiation absorbing agent is disposed within the closed chamber. The thermal radiation absorbing agent is transparent to the short wave visible radiation and substantially opaque to long wave infrared radiation. A substantial portion of the long wave infrared radiation absorbed by the thermal radiation absorbing agent is retained in the closed chamber.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
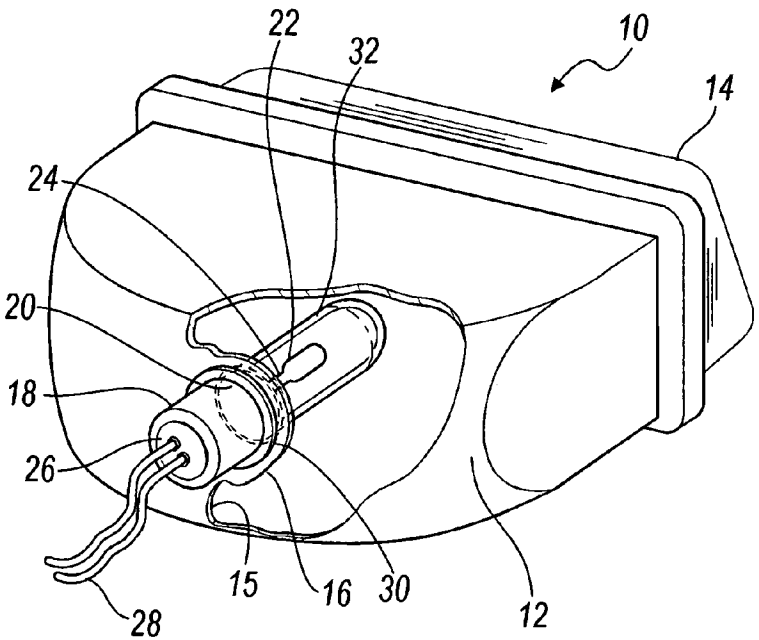
FIG. 1 is a perspective view of a lamp assembly for a vehicle.

Referring now to the Drawings and particularly to FIG. 1, there is shown generally at 10 a light fixture for a motor vehicle. The light fixture 10 is a lamp assembly for a motor vehicle. The lamp assembly includes housing 12 and a transparent lens 14 sealingly affixed to the front of the housing 12. The housing 12 includes a reflective surface 15 on at least one portion of an inner surface 16 of the housing 12.

A removable socket 18 is coupled to a rear of the housing 12. The removable socket 18 includes a first end 20 that is received at the rear of the housing 12. An illumination light source 22, such as a light bulb, includes a male terminal end 24 that is received and secured in the first end 20 of the removable socket 18. A second end 26 of the removable socket 18 is coupled to a conduit 28 for providing power the illumination light source 22.

An aperture 30 is formed in the rear of the housing 12 for receiving the illumination light source 22 therethrough. The illumination light source 22 extends through the aperture 30 to an interior of the lamp assembly as the removable socket 18 is secured to the rear of the housing 18. The removable socket 18 secures the illumination light source 22 within the lamp assembly so that illumination light source 22 is stationary within the lamp assembly. The removable socket 18 also positions the illumination light source 22 within the lamp assembly at a predetermined position from the reflective surface 15 so that visible light generated by the illumination light source 22 is reflected by the reflective surface 15 for illuminating an area forward of a vehicle's path.

A thermal filter 32 is disposed around the illumination light source 22 for reducing long wave infrared radiation from reaching the internal components of the lamp assembly. The thermal filter 32 is disposed between the illumination light source 22 and the reflective surface 15 in addition to the transparent lens 14. The thermal filter 32 is transparent to short wave radiation (i.e., visible light), but substantially opaque to long wave infrared radiation.

Figure 2:
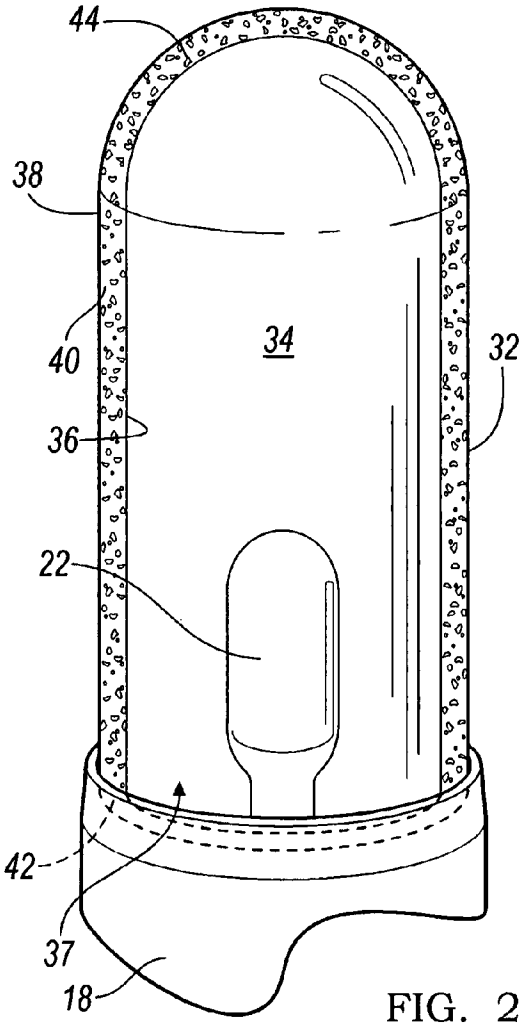
FIG. 2 is cross section view of a thermal filter assembly for a lamp assembly.

FIG. 2 illustrates the thermal filter 32 used to reduce long wave infrared radiation from reaching the lamp assembly components. The illumination light source 22 is disposed within the thermal filter 32. The thermal filter 32 is disposed over the illumination light source 22 thereby encapsulating the illumination source within an interior portion 34. The thermal filter 32 includes an inner envelope 36, such as a shell structure, that is disposed around the illumination light source 22. The inner envelope 36 is substantially tubular-shaped having an open end 37. The open end 37 is received by the removable socket 18. The inner envelope 36 is preferably made of glass and is transparent to short wave infrared radiation. Alternatively, the inner envelope may be produced from any transparent material having similar properties as glass.

The thermal filter 32 further includes an outer envelope 38 spaced a predetermined distance from the inner envelope 36 thereby forming a closed chamber 40 (e.g., glass chamber) therebetween. The outer envelope 38 is preferably made of glass or other similar material and is transparent to short wave radiation. The outer envelope 38 is substantially the same shape as the inner envelope 36. Alternatively, the shape of the inner envelope 36 and outer envelope 38 may be other than tubular-shaped or each respective envelope may include different shapes within a respective lamp assembly. Furthermore, the spacing between the respective envelopes may be non-uniform.

A closed end 42 of the inner envelope 36 and the outer envelope 38 are formed integral to one another for forming the closed chamber 40. The thermal filter 32 is coupled to the removable socket 18 and is positioned between the illumination light source 22 and selected portions of the housing 12. The thermal filter substantially encapsulates the illumination light source 22 within the interior portion 34 of the thermal filter 32 so that substantially all infrared radiation penetrating the inner envelope 36 is received by the thermal filter 32.

A thermal radiation absorbing agent 44 is disposed within the closed chamber 40 between the inner envelope 36 and the outer envelope 38. Preferably, the thermal radiation absorbing agent 44 includes carbon dioxide. Alternatively, the thermal radiation absorbing agent may include any green house gas such as methane, nitrous oxide, or chlorofluorocarbons (CFC's). The thermal radiation absorbing agent 44 is transparent to short wave infrared radiation, and as a result, allows visible light to pass through the thermal filter 32 for illuminating the vehicle pathway.

The thermal radiation absorbing agent 44 is substantially opaque to the long wave infrared radiation emitted by the illumination light source 22. The long wave infrared radiation is absorbed by the thermal radiation absorbing agent 44. Heat is generated by a portion of the absorbed long wave infrared radiation and is retained within the closed chamber 40. The portion of the long wave infrared radiation retained by the thermal radiation absorbing agent 44 within the closed chamber 40 is maintained therein until the illumination light source 22 is de-energized and the heat is dissipated thereafter.

The portion of the heat generated by long wave radiation and retained within the interior chamber 34 is exposed to the removable socket 18 and is thereafter dissipated through the removable socket 18.

The thermal filter 32 isolates the substantial portion of the long wave infrared radiation retained within the interior chamber 34 and closed chamber 40 from the majority of components of the lamp assembly (shown in FIG. 1). The components of the lamp assembly which are not subjected to the extreme heat generated by the long wave infrared radiation may utilize materials that do not require a high heat index since these components will be not exposed to elevated temperatures as a result of the thermal filter 32. In addition, respective lamp assemblies that required complex designs to avoid extreme heat expose to the lamp assembly components may be avoided since such components are not subjected to the extreme heat generated by the long wave infrared radiation. As a result, the cost as well as the complexity of the lamp design is reduced.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A thermal filter within a vehicle lamp assembly for reducing thermal radiation from reaching selected portions of the lamp assembly from an illumination light source disposed within the vehicle lamp, the thermal filter comprising:

an inner envelope having an interior portion that is open ended for receiving and enclosing the illumination light source therein;

an outer envelope of substantially identical shape and in spaced relation to the inner envelope, the inner envelope and the outer envelope being formed integral to one another at a first end, the first end adapted for being recessed within a removable socket and in contact with the removable socket, the inner and outer envelope defining a closed chamber therebetween, the closed chamber being disposed between the illumination light source and the selected portions of the lamp assembly; and a thermal radiation absorbing agent disposed within the closed chamber, the thermal radiation absorbing agent receiving radiation emitted from the illumination light source, the thermal radiation absorbing agent being transparent to short wave visible radiation and being substantially opaque to long wave infrared radiation, wherein long wave infrared radiation is absorbed by the absorbing agent within the closed chamber and is dissipated through the removable socket.

2. The thermal filter of claim 1 wherein the thermal radiation absorbing agent include carbon dioxide.

3. The thermal filter of claim 1 wherein the thermal radiation absorbing agent include methane.

4. The thermal filter of claim 1 wherein the inner envelope and the outer envelope comprise glass.

5. The thermal filter of claim 1 wherein the closed chamber retains a portion of the long wave infrared radiation.

6. The thermal filter of claim 1 wherein the thermal radiation absorbing agent includes a green house gas.

7. A lamp assembly for a vehicle lamp comprising:

an illumination light source that radiates short wave infrared radiation and long wave infrared radiation;

a lamp housing having a reflective surface on an interior surface of the lamp housing;

a removable socket for retaining an illumination light source at a predetermined position for illuminating the reflective surface;

a thermal filter disposed between the reflective surface and the illumination light source, the thermal filter comprising an inner envelope and an outer envelope formed integral to one another at a first end, a closed chamber being defined between the inner envelope and the outer envelope contains a thermal radiation absorbing agent, wherein the inner envelope includes an interior portion that is open ended for receiving and enclosing the illumination light source therein, wherein the first end is recessed within the removable socket and in contact with the removable socket, and wherein long wave infrared radiation is absorbed by the absorbing agent within the closed chamber and is dissipated through the removable socket.

8. The lamp assembly of claim 7 wherein the thermal radiation absorbing agent includes carbon dioxide.

9. The lamp assembly of claim 7 wherein the thermal filter is coupled to the socket for substantially enclosing the illumination light source within an interior portion defined by the thermal filter and socket.

10. A lamp assembly for a vehicle comprising:

a lamp housing;

a transparent lens affixed to the housing;

an illumination light source that radiates infrared radiation;

a removable socket providing an electrical connection to the illumination light source;

a thermal filter assembly disposed within the lamp housing enclosing the illumination light source, the thermal filter assembly is spaced between selected portions of the lamp assembly and the illumination light source, the filter assembly comprising:

an inner envelope having an interior portion that is open ended for receiving and enclosing the illumination light source therein;

an outer envelope positioned proximal to the inner envelope within the lamp housing, the outer envelope and the inner envelope are formed integral to one another at a first end for forming a closed chamber therebetween, the first end being recessed within the removable socket for coupling to the removable socket; and a thermal radiation absorbing agent disposed within the closed chamber, the thermal radiation absorbing agent being transparent to the short wave visible radiation and substantially opaque to long wave infrared radiation, wherein a substantial portion of the long wave infrared radiation is absorbed by the thermal radiation absorbing agent in the closed chamber and is dissipated through the removable socket.

11. The lamp assembly of claim 10 wherein the thermal radiation absorbing agent include carbon dioxide.

12. The lamp assembly of claim 10 wherein the inner envelope and the outer envelope comprise glass.

13. The lamp assembly of claim 10 wherein the open end of the thermal filter assembly is coupled to the socket for enclosing the illumination light source within the interior portion.

14. The lamp assembly of claim 7 wherein the socket is coupled to the closed chamber for dissipating heat generated by the absorbed long wave infrared radiation in the closed chamber.

15. The lamp assembly of claim 10 wherein the socket is coupled to the closed chamber for dissipating heat generated by the absorbed long wave infrared radiation in the closed chamber.

16. A thermal filter within a vehicle lamp assembly for reducing thermal radiation from reaching selected portions of the lamp assembly from an illumination light source disposed within the vehicle lamp, the thermal filter comprising:

an inner envelope having an interior portion that is open ended for receiving and enclosing the illumination light source therein;

an outer envelope in spaced relation to the inner envelope, a closed end of the inner envelope and the outer envelope formed integral to one another for defining a closed chamber therebetween, the closed chamber being disposed between the illumination light source and the selected portions of the lamp assembly; and a thermal radiation absorbing agent that includes nitrous oxide disposed within the closed chamber, the thermal radiation absorbing agent receiving radiation emitted from the illumination source, the thermal radiation absorbing agent being transparent to short wave visible radiation and being substantially opaque to long wave infrared radiation, a substantial portion of the long wave infrared radiation absorbed by the absorbing agent is retained within the closed chamber.

17. A thermal filter within a vehicle lamp assembly for reducing thermal radiation from reaching selected portions of the lamp assembly from an illumination light source disposed within the vehicle lamp, the thermal filter comprising:

an inner envelope having an interior portion, an outer envelope in spaced relation to the inner envelope, a closed end of the inner envelope and the outer envelope formed integral to one another for defining a closed chamber therebetween, the closed chamber being disposed between the illumination light source and the selected portions of the lamp assembly; and a thermal radiation absorbing agent that includes chlorofluorocarbons disposed within the closed chamber, the thermal radiation absorbing agent receiving radiation emitted from the illumination source, the thermal radiation absorbing agent being transparent to short wave visible radiation and being substantially opaque to long wave infrared radiation, a substantial portion of the long wave infrared radiation absorbed by the absorbing agent is retained within the closed chamber.

18. A thermal dissipation apparatus within a vehicle lamp assembly for reducing thermal radiation from reaching selected portions of the lamp assembly from an illumination light source disposed within the vehicle lamp, the thermal filter comprising:

an inner envelope having an interior portion that is open ended for receiving and enclosing the illumination light source therein;

an outer envelope in spaced relation to the inner envelope, a closed end of the inner envelope and the outer envelope formed integral to one another for defining a closed chamber therebetween, the closed chamber being disposed between the illumination light source and the selected portions of the lamp assembly;

a thermal radiation absorbing agent disposed within the closed chamber, the thermal radiation absorbing agent receiving radiation emitted from the illumination source, the thermal radiation absorbing agent being transparent to short wave visible radiation and being substantially opaque to long wave infrared radiation, long wave infrared radiation absorbed by the absorbing agent is retained within the closed chamber; and a thermal dissipation member is in thermal contact with the closed chamber for dissipating heat generated by the long wave infrared radiation through the thermal dissipation member, a portion of the closed chamber being recessed within the thermal dissipation member for making the thermal contact with the thermal dissipation member.

19. The thermal dissipation apparatus of claim 18 wherein the thermal dissipation member includes a removable socket.

20. The thermal dissipation apparatus of claim 19 wherein the removable socket is coupled to the illumination light source for providing an electrical connection to the illumination light source.

* * * * *